US010140921B2

(12) United States Patent
Kim et al.

(10) Patent No.: US 10,140,921 B2
(45) Date of Patent: Nov. 27, 2018

(54) EM SIGNAL CONTROL CIRCUIT, EM SIGNAL CONTROL METHOD AND ORGANIC LIGHT EMITTING DISPLAY DEVICE

(71) Applicant: LG DISPLAY CO., LTD., Seoul (KR)

(72) Inventors: Hyoung-Su Kim, Anyang-si (KR); Euitae Kim, Paju-si (KR); KiSeob Shin, Seoul (KR); Yongmin Jeong, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 107 days.

(21) Appl. No.: 15/376,059

(22) Filed: Dec. 12, 2016

(65) Prior Publication Data

US 2017/0193911 A1 Jul. 6, 2017

(30) Foreign Application Priority Data

Dec. 30, 2015 (KR) ..... 10-2015-0189223

(51) Int. Cl.
*G09G 3/3233* (2016.01)
*G09G 3/3258* (2016.01)
(Continued)

(52) U.S. Cl.
CPC ..... *G09G 3/3258* (2013.01); *G09G 3/3233* (2013.01); *G09G 3/2014* (2013.01);
(Continued)

(58) Field of Classification Search
CPC .. G09G 3/3258; G09G 3/3233; G09G 3/2014; G09G 3/3266; G09G 2300/0861;
(Continued)

(56) References Cited

U.S. PATENT DOCUMENTS 4,868,427 A * 9/1989 Fitzpatrick ..... H03K 19/01853 326/74
4,929,911 A * 5/1990 Davies ..... H03K 19/00315 330/264

(Continued)

FOREIGN PATENT DOCUMENTS

EP 2672479 A1 12/2013
JP 2011-164606 A 8/2011

(Continued)

*Primary Examiner* — Julie Anne Watko
(74) *Attorney, Agent, or Firm* — Birch, Stewart, Kolasch & Birch, LLP

(57) ABSTRACT

Various embodiments relate to an EM signal control circuit, an EM signal control method, and an organic light emitting display device. The EM signal control circuit according to an embodiment of the present invention includes additional elements (e.g., a transistor and a capacitor) configured to separate a set signal from a gate electrode of a transistor coupled to an output node and to stably keep turn-off of a transistor coupled to the output node. Voltage levels of a first emission power source and a first gate power source may be set differently from each other according to the present invention. Therefore, despite of a threshold voltage change of a transistor coupled to an output node, the transistor may remain turned off stably, thereby improving the reliability of the EM signal.

14 Claims, 8 Drawing Sheets

(51) Int. Cl.
*G09G 3/3266* (2016.01)
*G09G 3/20* (2006.01)

(52) U.S. Cl.
CPC ... *G09G 3/3266* (2013.01); *G09G 2300/0852* (2013.01); *G09G 2300/0861* (2013.01); *G09G 2300/0866* (2013.01); *G09G 2300/0871* (2013.01); *G09G 2310/027* (2013.01); *G09G 2310/0286* (2013.01); *G09G 2310/0289* (2013.01); *G09G 2310/08* (2013.01); *G09G 2330/02* (2013.01); *G09G 2330/021* (2013.01)

(58) Field of Classification Search
CPC ..... G09G 2300/0871; G09G 2310/027; G09G 2310/0286; G09G 2310/08; G09G 2330/021; G09G 3/3275; G09G 2300/0866; G09G 2300/0852; G09G 2300/0876; G09G 2310/0289; G09G 2330/023; G09G 2330/02; G09G 2330/00
See application file for complete search history.

(56) References Cited

U.S. PATENT DOCUMENTS

| | | | | |
|---|---|---|---|---|
| 5,304,867 | A * | 4/1994 | Morris | H03K 19/01852 326/68 |
| 9,978,305 | B2 * | 5/2018 | In | G09G 3/3208 |
| 2010/0188316 | A1 | 7/2010 | Jang | |
| 2011/0193892 | A1 * | 8/2011 | Eom | G09G 3/3266 345/690 |
| 2012/0038609 | A1 | 2/2012 | Chung | |
| 2012/0229444 | A1 * | 9/2012 | Ochiai | G11C 19/184 345/213 |
| 2014/0204009 | A1 | 7/2014 | Kim et al. | |
| 2015/0364079 | A1 | 12/2015 | Nie et al. | |

FOREIGN PATENT DOCUMENTS

| | | | |
|---|---|---|---|
| JP | 2012-189752 | A | 10/2012 |
| KR | 10-2007-0100545 | A | 10/2007 |
| KR | 10-2008-0114365 | A | 12/2008 |
| KR | 10-2012-0077792 | A | 7/2012 |

* cited by examiner

EM SIGNAL CONTROL CIRCUIT, EM SIGNAL CONTROL METHOD AND ORGANIC LIGHT EMITTING DISPLAY DEVICE

CROSS-REFERENCES TO RELATED APPLICATION

The present application claims priority under 35 U.S.C. § 119(a) to Korean application No. 10-2015-0189223, filed on Dec. 30, 2015, in the Korean Intellectual Property Office, which is incorporated herein by reference in its entirety as set forth in full.

BACKGROUND

1. Technical Field

Various embodiments relate to an EM (Emission) signal control circuit, an EM signal control method, and an organic light emitting display device.

2. Related Art

Various types of electronic apparatuses including a mobile phone, a tablet PC, a notebook and so forth use a flat panel display (FPD) device. Examples of the FPD are a liquid crystal display (LCD) device, a plasma display panel (PDP) device, an organic light emitting display device (OLED), and an electrophoretic display (EPD) device.

Among the flat panel display devices, the organic light emitting display device is a spontaneously light emitting device capable of displaying images through light-emission of an organic light emitting diode by using the re-aggregation of the hole and the electron. The organic light emitting display device has characteristics of high-speed response and low power consumption. The organic light emitting display device shows an excellent viewing angle due to the use of the spontaneous light emitting element. Therefore, the organic light emitting display device draws attention as the next-generation flat panel display device.

An organic light emitting display device according to the related art has plural pixels disposed on a panel. Each of the plural pixels includes an organic light emitting diode (OLED) element and plural transistors each configured to apply currents to the organic light emitting diode element. Applied to the transistors of the respective pixels are a scan signal, a data signal, and an EM signal for controlling turn-on/off of the OLED element.

FIG. 1 is a configuration diagram illustrating a shift register and an EM signal control circuit included in an organic light emitting display device according to a related art. As shown in FIG. 1, the organic light emitting display device includes shift registers SR1 and SR2 and an EM signal control circuit INV coupled to the shift registers SR1 and SR2.

As illustrated in FIG. 1, the shift registers SR1 and SR2 generate scan signals Scan1 and Scan2 by using gate electrode power voltages G1VGH, G1VGL, G2VGH, and G2VGL, gate electrode start voltages G1VST and G2VST, and clock signals G1CLK1 to G1CLK4 and G2CLK1 to G2CLK4. The EM signal control circuit INV generates an EM signal EM by using emission power voltages EVGH and EVGL, the clock signal G1CLK2, and the scan signal Scan1.

FIG. 2 is a configuration diagram illustrating an EM signal control circuit according to a related art, and FIG. 3 is a waveform diagram illustrating respective signals according to the operation of the EM signal control circuit of FIG. 2. It is assumed hereinafter that a voltage of a first emission power source EVGH and a voltage of a first gate power source GVGH are respectively 14V and a voltage of a second emission power source EVGL and a voltage of a second gate power source GVGL are respectively −6V. Further, it is assumed that a set signal SET and a reset signal RESET are a low voltage level of −6V and a high voltage level of 14V, respectively.

Referring to FIGS. 2 and 3, the scan signal Scan1 of −6V is applied as the set signal SET to a QB node during a time section "t1". Due to the application of the set signal SET during the time section "t1", a voltage level of −6V is generated on the QB node and turns on a transistor T11, and the first emission power source EVGH is output as the EM signal EM through an output node NOUT. As the voltage level of −6V on the QB node also turns on a transistor T13, a voltage level of the first gate power source GVGH (i.e., a voltage level of 14V) is generated on a Q node, and thus a transistor T12 is turned off. Accordingly, as illustrated in FIG. 3, the first emission power source EVGH of 14V having the opposite level to the set signal SET of −6V is output as the EM signal EM during the time section "t1".

Next, during a time section "t2", a clock signal CLK2 of −6V is applied as the reset signal RESET to a gate electrode of a transistor T14, and the set signal SET of 14V is applied to the QB node. Accordingly, the transistor T14 is turned on and a voltage level of −6V is generated on the Q node. Therefore, the transistor T12 is turned on and the second emission power source EVGL of −6V is output as the EM signal EM. At this time, the voltage level of −6V on the Q node is maintained by a capacitor C. Therefore, the voltage level of the EM signal EM stays to −6V because of the voltage level of −6V maintained by the capacitor C despite periodical application of the reset signal RESET after the time section "t2".

An organic light emitting display device according to the related art is capable of adjusting the brightness of a panel according to an external illuminance in order to improve power consumption and image quality under a low-illuminance circumstance. Such brightness adjustment may be implemented by a data voltage applied to the panel or by the EM signal EM generated as described above. That is, the turn-off time section of the respective pixels may be adjusted by adjusting the turn-on time section of the EM signal EM (e.g., the time section "t1" described with reference to FIG. 3). Such drive is referred to as an EM duty drive.

FIG. 4 is a waveform diagram illustrating respective signals according to the EM duty drive of the EM signal control circuit according to a related art.

Referring to FIGS. 2 and 4, the set signal SET of −6V is applied to the QB node during the time section "t1", as described above. Therefore, the transistor T11 is turned on, and the first emission power source EVGH of 14V is output as the EM signal EM through the output node NOUT.

Next, during a time section "t2", the voltage level of the EM signal EM is maintained to 14V in order to keep the organic light emitting diode element turned off for a predetermined time. To this end, the set signal SET and the reset signal RESET both having a voltage level of 14V are applied to the EM signal control circuit of FIG. 2.

However, in the case of keeping both of the set signal SET and the reset signal RESET to the voltage level of 14V, both of the transistor T11 and the transistor T12 of FIG. 2 are turned off and thus the output node NOUT is floated. Accordingly, the normal output of the EM signal EM through the output node NOUT cannot be secured during the time section "t2".

During a time section "t3", the reset signal RESET of −6V is applied to the transistor T14 and thus the transistor T12 is turned on. Therefore, the voltage level of the EM signal EM is −6V. After the time section "t3", the voltage level of the set signal SET should be kept to 14V, and the voltage level of the EM signal EM should be kept to −6V regardless of the application of the reset signal RESET.

However, a threshold voltage of the transistor T11 is susceptible to change by a process condition of the transistor while manufacturing the organic light emitting display device, change of external temperature while driving the organic light emitting display device, deterioration of the transistor, and so forth. Therefore, despite the voltage level (i.e., 14V) of the set signal SET applied to the QB node of FIG. 2, the voltage level of the EM signal EM erroneously rises during a time section "t4" or a time section "t6" as illustrated in FIG. 4 due to the threshold voltage change of the transistor T11.

Accordingly, what is needed is an EM signal control circuit capable of preventing the floating of the output node NOUT during the time section "t2" and the voltage level change of the EM signal EM during the time section "t4" or the time section "t6" discussed with reference to FIG. 4.

SUMMARY

Various embodiments of the present invention are directed to an EM signal control circuit capable of preventing a floating of an output node due to turn-off of transistors coupled to the output node during an EM duty drive operation thereof, an EM signal control method, and an organic light emitting display device.

Further, various embodiments of the present invention are directed to an EM signal control circuit capable of preventing a voltage level change of an EM signal due to a change of a transistor coupled to an output node during an EM duty drive operation thereof, an EM signal control method, and an organic light emitting display device.

While certain objectives have been described above, it will be understood to those skilled in the art that the objectives described are by way of example only. Accordingly, the present invention should not be limited based on the described objectives. Rather, the present invention described herein should only be limited in light of the claims that follow when taken in conjunction with the above description and accompanying drawings.

As described above, the EM signal control circuit according to the related art cannot secure the normal output of the EM signal EM through the output node NOUT during the time section when all the transistors coupled to the output node NOUT are turned off and thus the output node NOUT is floated during the EM duty drive operation.

In order to overcome or address such problems and limitations associated with the related art and in order to improve the reliability of the EM signal, an EM signal control circuit according to an embodiment of the present invention may include additional elements (e.g., a transistor and a capacitor) configured to separate a set signal from a gate electrode of a transistor coupled to an output node and to stably keep turn-off of a transistor coupled to the output node.

Also as described above, the EM signal control circuit according to the related art erroneously changes the voltage level of the EM signal due to the threshold voltage change of the transistor occurring in the manufacturing process, the driving process, and so forth.

In order to overcome or address such problems and limitations associated with the related art, voltage levels of a first emission power source and a first gate power source may be set differently from each other in accordance with an embodiment of the present invention. Therefore, despite of the threshold voltage change of a transistor coupled to an output node, the transistor may remain turned off stably, thereby improving the reliability of the EM signal.

In accordance with an embodiment of the present invention, an EM signal control circuit of an organic light emitting display device may include a first transistor, where a drain electrode of the first transistor is coupled to a first emission power source, a gate electrode of the first transistor is coupled to a QB node, and the first transistor is configured to output a voltage of the first emission power source to an output node coupled to a source electrode thereof in response to a set signal; a second transistor, where a source electrode of the second transistor is coupled to a second emission power source, a gate electrode of the second transistor is coupled to a Q node, and the second transistor is configured to output a voltage of the second emission power source to the output node coupled to a drain electrode thereof in response to a reset signal; a third transistor, where a source electrode of the third transistor is coupled to a second gate power source, a drain electrode of the third transistor is coupled to the QB node, and the third transistor is configured to transfer a voltage of the second gate power source to the QB node in response to the set signal; a fourth transistor, where a drain electrode of the fourth transistor is coupled to a first gate power source, a source electrode of the fourth transistor coupled to the QB node, a gate electrode of the fourth transistor is coupled to the Q node, and the fourth transistor is configured to transfer a voltage of the first gate power source to the QB node in response to the reset signal; and a first capacitor coupled between the QB node and the drain electrode of the first transistor.

In accordance with an embodiment of the present invention, an EM signal control method of an organic light emitting display device may include turning on a third transistor and a first transistor coupled to the third transistor at a QB node by applying a set signal to output a voltage of a first emission power source to an output node; turning off the third transistor and outputting the voltage of the first emission power source to the output node using a voltage maintained by a first capacitor, the first capacitor is coupled between the first transistor and the QB node; and turning on a fifth transistor and a second transistor coupled to the fifth transistor at a Q node by applying a reset signal to output a voltage of a second emission power source to the output node.

In accordance with an embodiment of the present invention, an organic light emitting display device may include a panel including a plurality of pixels; a plurality of shift registers configured to provide scan signals to the respective pixels; and an EM signal control circuit coupled to the plurality of shift registers and configured to provide EM signals to the respective pixels, wherein the EM signal control circuit includes: a first transistor, where a drain electrode of the first transistor is coupled to a first emission power source, a gate electrode of the first transistor is coupled to a QB node, and the first transistor is configured to output a voltage of the first emission power source to an output node coupled to a source electrode thereof in response to a set signal; a second transistor, where a source electrode of the second transistor is coupled to a second emission power source, a gate electrode of the second transistor is coupled to a Q node, and the second transistor is configured to output a voltage of the second emission power source to the output node coupled to a drain electrode thereof in response to a reset signal; a third transistor, where a source electrode of the third transistor is coupled to a second gate power source, a drain electrode of the third transistor is coupled to the QB node, and the third transistor is configured to transfer a voltage of the second gate power source to the QB node in response to the set signal; a fourth transistor, where a drain electrode of the fourth transistor is coupled to a first gate power source, a source electrode of the fourth transistor coupled to the QB node, a gate electrode of the fourth transistor is coupled to the Q node, and the fourth transistor is configured to transfer a voltage of the first gate power source to the QB node in response to the reset signal; and a first capacitor coupled between the QB node and the drain electrode of the first transistor.

In accordance with an embodiment of the present invention, an EM signal control circuit may prevent the floating state when transistors coupled to the output node are turned off during the EM duty drive of the EM signal control circuit.

In accordance with an embodiment of the present invention, an EM signal control circuit may prevent the voltage level change of an EM signal during the EM duty drive of the EM signal control circuit despite the threshold voltage change of a transistor coupled to an output node.

DETAILED DESCRIPTION OF THE EMBODIMENTS

Figure 1:
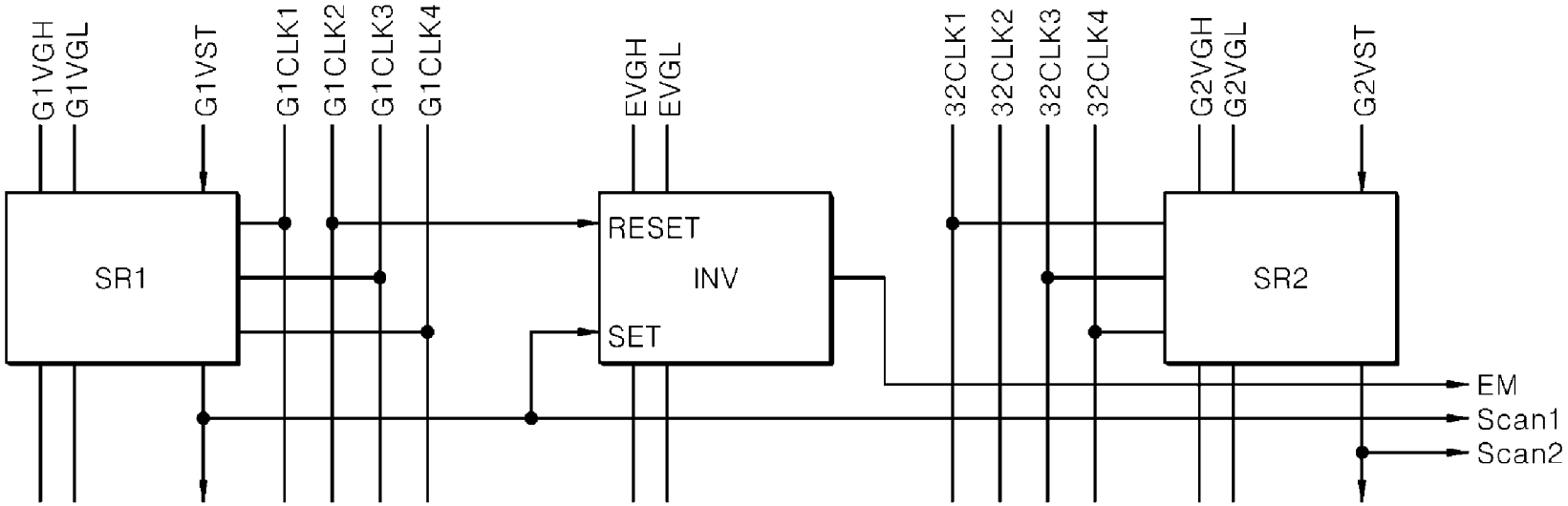
FIG. 1 (RELATED ART)
FIG. 1 is a configuration diagram illustrating a shift register and an EM signal control circuit included in an organic light emitting display device according to a related art.
Figure 2:
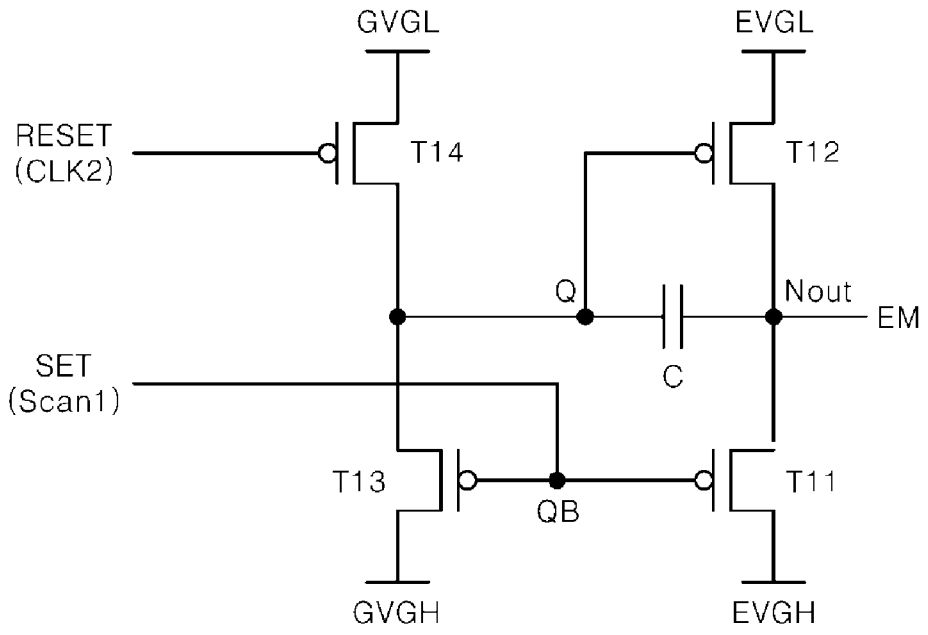
FIG. 2 (RELATED ART)
FIG. 2 is a configuration diagram illustrating an EM signal control circuit according to a related art.
Figure 3:
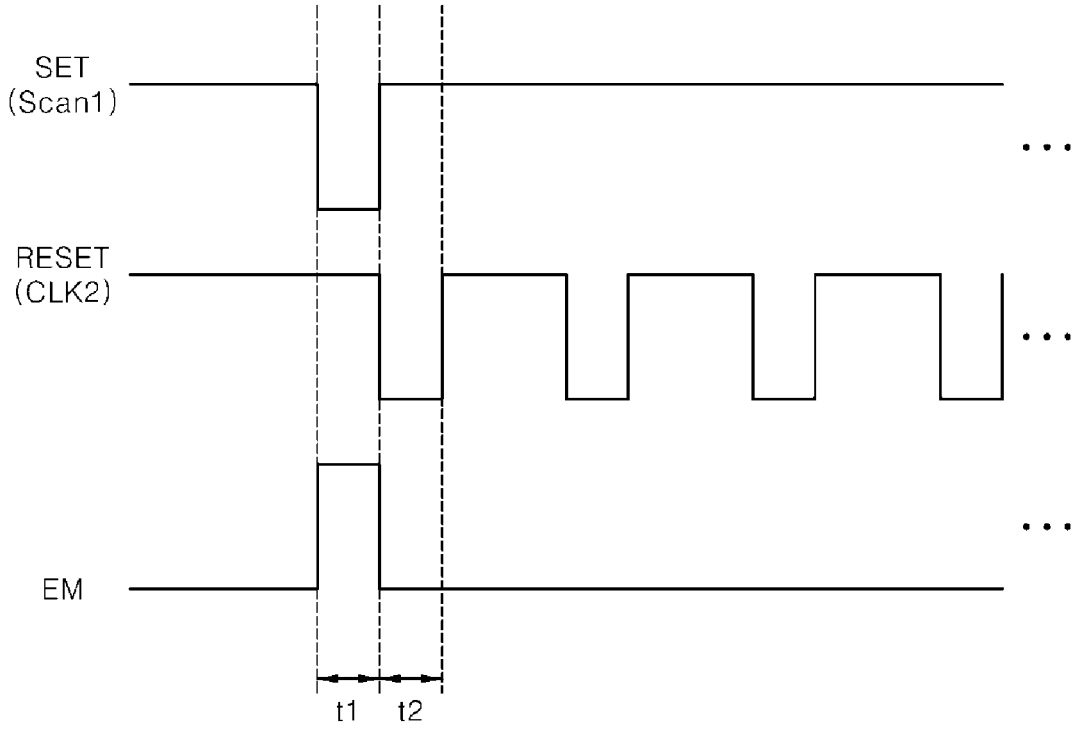
FIG. 3 (RELATED ART)
FIG. 3 is a waveform diagram illustrating respective signals according to the operation of the EM signal control circuit of FIG. 2.

Various embodiments will be described below in more detail with reference to the accompanying drawings. The present invention may, however, be embodied in different forms and should not be construed as limited to the embodiments set forth herein. Rather, these embodiments are provided so that this disclosure will be thorough and complete and will fully convey the scope of the present invention to those skilled in the art. In the description below, it should be noted that only parts necessary for understanding operations according to various exemplary embodiments of the present invention will be described, and descriptions of other parts may be omitted so as to avoid unnecessarily obscuring the subject matter of the present invention. However, the present invention is not limited to the exemplary embodiments described herein, and may be implemented in various different forms. Hereafter, exemplary embodiments will be described with reference to the accompanying drawings. Throughout the disclosure, reference numerals correspond directly to like parts in the various figures and embodiments of the present invention.

Figure 5:
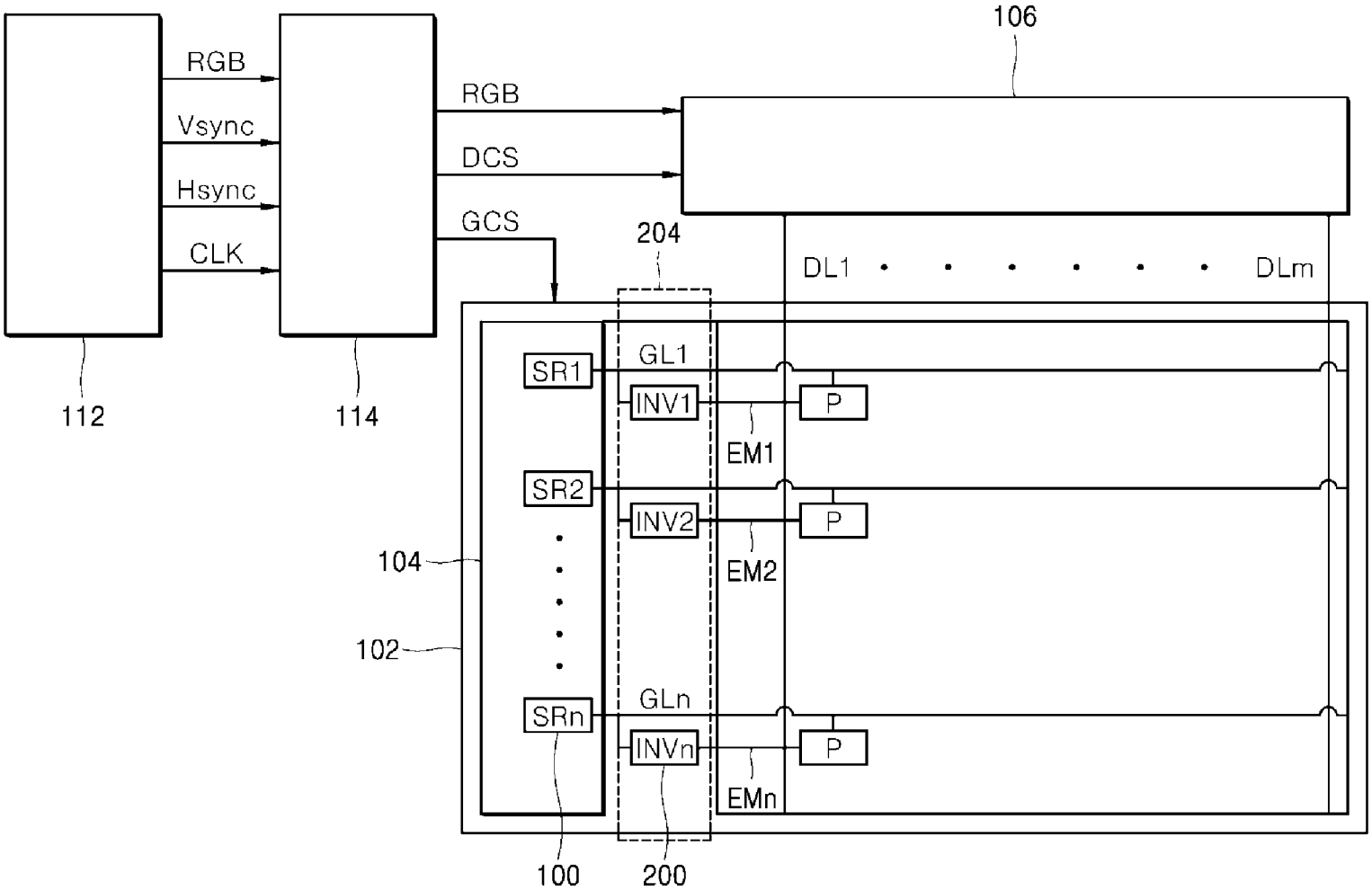
FIG. 5 is a configuration diagram illustrating an organic light emitting display device in accordance with an embodiment of the present invention.

FIG. 5 is a configuration diagram illustrating an organic light emitting display device in accordance with an embodiment of the present invention. All the components of the organic light emitting display device according to all embodiments of the present invention are operatively coupled and configured.

Referring to FIG. 5, the organic light emitting display device may include a timing controller 114, a gate electrode driver 104, a data driver 106, and a panel 102.

The timing controller 114 may receive a digital video data RGB, vertical/horizontal synchronization signals Vsync and Hsync, and a clock signal CLK from a system 112 disposed inside or outside the organic light emitting display device. The timing controller 114 may generate and output a gate electrode control signal GCS and a data control signal DCS for respectively controlling the drive of the gate electrode driver 104 and the data driver 106 by using the provided vertical/horizontal synchronization signals Vsync and Hsync and clock signal CLK. Further, the timing controller 114 may rearrange the digital video data RGB according to the resolution of the panel 102, and provide the rearranged digital video data RGB to the data driver 106.

The gate electrode driver 104 may provide scan signals to gate electrode lines GL1 to GLn of the panel 102 in response to the gate electrode control signal GCS. The gate electrode driver 104 may provide the scan signals to gate electrode lines GL1 to GLn in response to the gate electrode control signal GCS provided from the timing controller 114.

The data driver 106 may convert the digital video data RGB into an analogue pixel signal (e.g., a data signal or a data voltage) corresponding to a grayscale value in response to the data control signal DCS provided from the timing controller 114. The converted analogue signal may be provided to data lines DL1 to DLm of the panel 102.

The panel 102 may include a plurality of pixels P disposed on intersections of the plural gate electrode lines GL and the plural data lines DL. Each pixel P may include a switching transistor that is driven by a corresponding gate electrode line GL, a driving transistor that is turned on by an image signal provided through the switching transistor, an emission transistor that is driven by an EM signal, and an organic light emitting diode. An image signal provided through the data lines DL may be transferred to the driving transistor through the switching transistor that is turned on by a scan signal provided through the gate electrode lines GL. When the emission transistor is turned on by an EM signal, the organic light emitting diode may light-emit by currents flowing therein through the driving transistor.

Referring to FIG. 5, the gate electrode driver 104 may include a plurality of shift register SR1 to SRn configured to generate scan signals. The panel 102 may include an EM signal control unit 204 configured to transfer EM signals to the respective pixels P. The EM signal control unit 204 may include a plurality of EM signal control circuits INV1 to INVn. The plurality of EM signal control circuits INV1 to INVn may be coupled to the plurality of shift register SR1 to SRn, respectively, and may generate the EM signals by using output signals of the plurality of shift register SR1 to SRn.

The organic light emitting display device may further include a power supply unit configured to provide power for driving the timing controller 114, the gate electrode driver 104, the data driver 106, and the panel 102.

Hereinafter, described will be the configuration and operation of the EM signal control circuits INV1 to INVn in accordance with an embodiment of the present invention.

Figure 6:
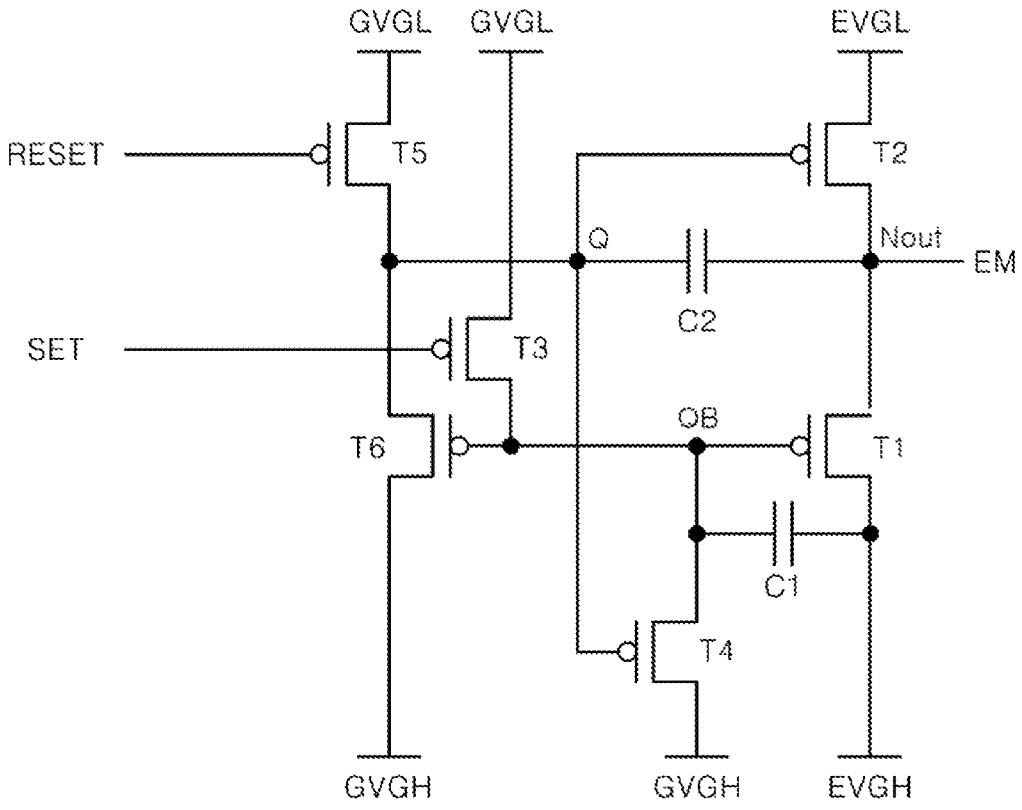
FIG. 6 is a configuration diagram illustrating an EM signal control circuit in accordance with an embodiment of the present invention.

FIG. 6 is a configuration diagram illustrating an EM signal control circuit in accordance with an embodiment of the present invention.

Referring to FIG. 6, the EM signal control circuit may include first to sixth transistors T1 to T6, a first capacitor C1 and a second capacitor C2.

The first transistor T1 may output a voltage of the first emission power source EVGH to an output node Nout coupled to a source electrode thereof in response to a set signal SET. The first transistor T1 may be coupled to the first emission power source EVGH at its drain electrode and coupled to a QB node at its gate electrode.

The second transistor T2 may output a voltage of the second emission power source EVGL to the output node Nout coupled to a drain electrode thereof in response to a reset signal RESET. The second transistor T2 may be coupled to the second emission power source EVGL at its source electrode and coupled to a Q node at its gate electrode.

The third transistor T3 may transfer a voltage of the second gate power source GVGL to the QB node in response to the set signal SET. The third transistor T3 may be coupled to the second gate power source GVGL at its source electrode and coupled to the QB node at its drain electrode.

The fourth transistor T4 may transfer a voltage of the first gate power source GVGH to the QB node in response to the reset signal RESET. The fourth transistor T4 may be coupled to the first gate power source GVGH at its drain electrode, coupled to the QB node at its source electrode, and coupled to the Q node at its gate electrode.

The first capacitor C1 may be coupled between the QB node and the drain electrode of the first transistor T1. The second capacitor C2 may be coupled between the Q node and the output node Nout.

The fifth transistor T5 may transfer the voltage of the second gate power source GVGL to the Q node in response to the reset signal RESET. The fifth transistor T5 may be coupled to the second gate power source GVGL at its source electrode and coupled to the Q node at its drain electrode.

The sixth transistor T6 may be turned on in response to the set signal SET, and may transfer the voltage of the first gate power source GVGH to the Q node. Accordingly, the second transistor T2 may become turned off while the voltage of the emission power source EVGH is output to the output node Nout through the first transistor T1.

Hereinafter, the operation of generating the EM signal and the EM duty drive of the EM signal control circuit will be described with reference to FIGS. 6 and 7. It is assumed hereinafter that the voltage of the first emission power source EVGH is 14V, the voltage of the second emission power source EVGL is −6V, the voltage of the first gate power source GVGH is 16V, and the voltage of the second gate power source GVGL is −6V. Further, it is assumed that the set signal SET and the reset signal RESET are a low voltage level of −6V and a high voltage level of 16V, respectively. It is noted that the assumed voltage levels of the first emission power source EVGH, the second emission power source EVGL, the first gate power source GVGH, the second gate power source GVGL, the set signal SET and the reset signal RESET are only for exemplary purpose and will not limit the scope of the present invention, and the voltage levels may vary according to embodiments.

Figure 7:
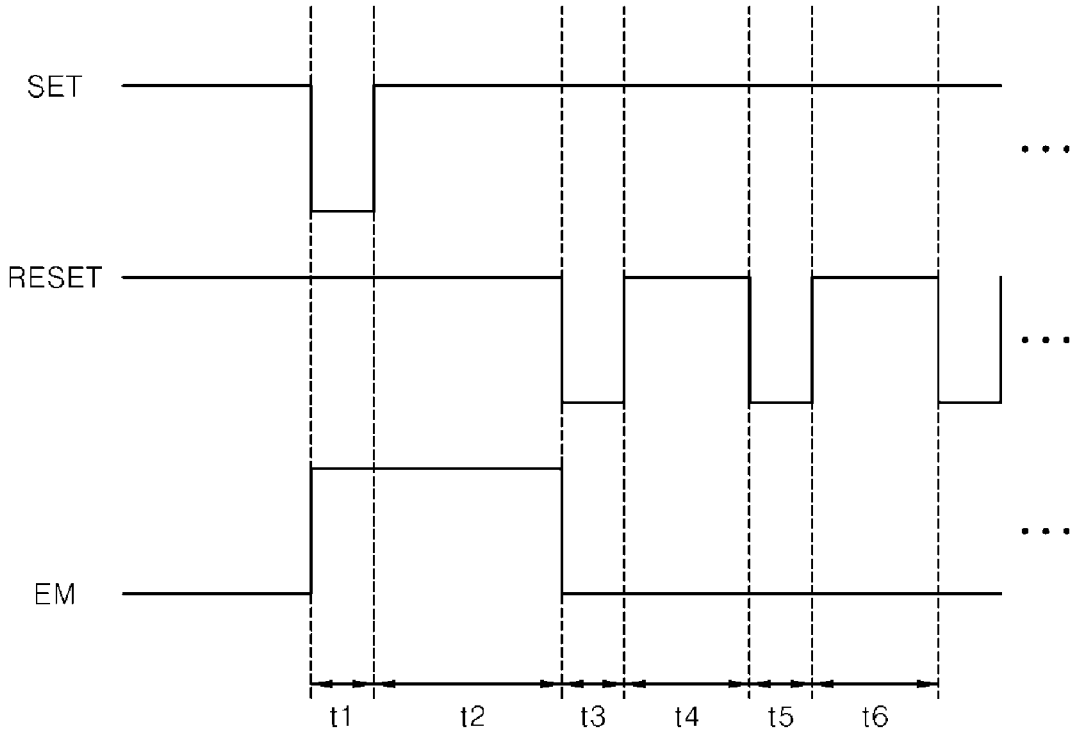
FIG. 7 is a waveform diagram illustrating respective signals according to the operation of the EM signal control circuit of FIG. 6.

FIG. 7 is a waveform diagram illustrating respective signals according to the operation of the EM signal control circuit of FIG. 6.

Referring to FIGS. 6 and 7, the set signal SET of −6V may be applied to the gate electrode of the third transistor T3 during a time section "t1". Accordingly, the third transistor T3 may be turned on and the voltage of the second gate power source GVGL of −6V may be transferred to the QB node.

Due to the transferred voltage level of −6V on the QB node, the first transistor T1 and the sixth transistor T6 may be turned on. Upon the turn on of the first transistor T1, the voltage of the first emission power source EVGH of 14V may be output to the output node Nout through the first transistor T1. Accordingly, the EM signal control circuit may output the EM signal of 14V during the time section "t1", as illustrated in FIG. 7. At this time, the voltage level of −6V transferred to the QB node may be maintained by the first capacitor C1.

Also, upon the turn on of the sixth transistor T6, the voltage of the first gate power source GVGH of 16V may be transferred to the Q node. Accordingly, the second transistor T2 may be kept turned off during the time section "t1".

Next, during a time section "t2", the set signal SET of 16V may be applied to the gate electrode of the third transistor T3. Accordingly, the third transistor T3 may be turned off. According to the related art described with reference to FIG. 4, when the third transistor T3 becomes turned off, both of the first transistor T1 and the second transistor T2 are turned off and thus the output node NOUT becomes floated. Accordingly, the normal output of the EM signal EM through the output node NOUT cannot be secured during the time section "t2".

However, in accordance with an embodiment of the present invention, the first transistor T1 may remain turned on due to the voltage level of −6V of the first capacitor C1 despite the turn off of the third transistor T3 during the time section "t2". Accordingly, the voltage of the first emission power source EVGH of 14V may be kept being output to the output node Nout during the time section "t2". In accordance with an embodiment of the present invention, the EM signal control circuit may stably output the normal EM signal EM through the output node even while both of the set signal SET and the reset signal RESET are provided with the voltage level of 16V (i.e., even during the time section "t2").

The timing controller 114 may determine the end of the EM duty drive operation (i.e., the end of the time section "t2"). The duty of the EM duty drive may be determined according to the end of the time section "t2".

Next, during a time section "t3", the reset signal RESET of −6V may be applied to the gate electrode of the fifth transistor T5. Accordingly, the fifth transistor T5 may be turned on and the voltage of the second gate power source GVGL of −6V may be transferred to the Q node through the fifth transistor T5.

Due to the transferred voltage level of −6V on the Q node, the second transistor T2 may be turned on and the voltage of the second emission power source EVGL of −6V may be output to the output node Nout through the second transistor T2. Accordingly, the voltage level of the EM signal may be changed to −6V during the time section "t3", as illustrated in FIG. 7. At this time, the voltage level of −6V transferred to the Q node may be maintained by the second capacitor C2.

Due to the transferred voltage level of −6V on the Q node, the fourth transistor T4 may be turned on and the voltage of the first gate power source GVGH of 16V may be transferred to the QB node through the fourth transistor T4. Accordingly, the first transistor T1 may keep turned off during the time section "t3".

Next, during a time section "t4", the reset signal RESET of 16V may be applied to the gate electrode of the fifth transistor T5. Accordingly, the fifth transistor T5 may be turned off. However, the second transistor T2 may keep turned on due to the voltage level of −6V maintained by the second capacitor C2. Accordingly, the voltage level of the EM signal EM may keep to the voltage level of −6V.

Figure 4:
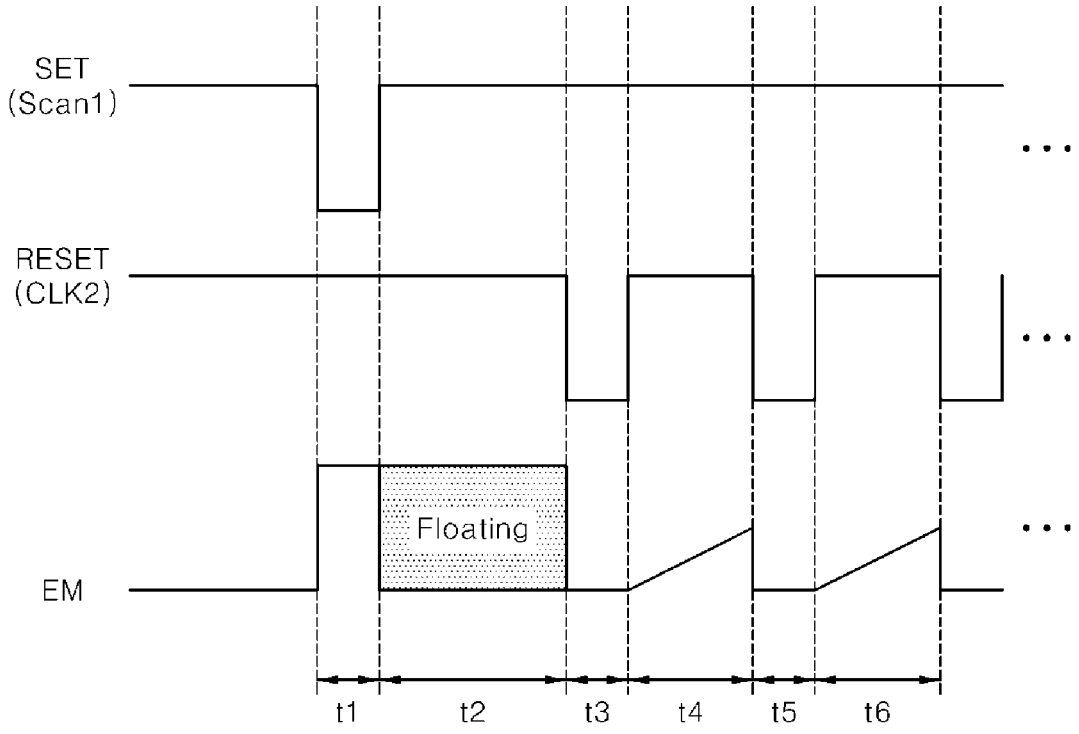
FIG. 4 (RELATED ART)
FIG. 4 is a waveform diagram illustrating respective signals according to the EM duty drive of an EM signal control circuit according to a related art.

According to the related art described with reference to FIG. 4, there may occur a case that the voltage level of the EM signal EM erroneously rises although the voltage level of the EM signal EM is supposed to keep to −6V during the time section "t4". Such case may occur due to the threshold voltage change of the first transistor T1 by a process condition of a transistor while manufacturing the organic light emitting display device, change of external temperature while driving the organic light emitting display device, deterioration of the transistor, and so forth. That is, despite of the voltage of the first gate power source GVGH applied to the QB node, the voltage level of the EM signal EM may erroneously rise during the time section "t4" due to the threshold voltage change of the first transistor T1.

However, in accordance with an embodiment of the present invention, the voltage levels of the first gate power source GVGH and the first emission power source EVGH may be set differently from each other in order to prevent the erroneous change of the voltage level of the EM signal EM in the time section "t4". For example, the voltage levels of the first gate power source GVGH and the first emission power source EVGH may be set to 16V and 14V, respectively, in the embodiment exemplified in FIG. 7. Discrepancy (for example, −2V) in such different voltage levels between the first gate power source GVGH and the first emission power source EVGH may be applied to the gate electrode of the first transistor T1. Accordingly, despite of the threshold voltage change of the first transistor T1, the first transistor T1 may remain turned off stably and the voltage level of the EM signal EM may also be stably maintained during the time section "t4".

The discrepancy in the voltage levels of the first gate power source GVGH and the first emission power source EVGH may be determined according to an amount of the threshold voltage change of the first transistor T1. That is, when it is expected that the amount of the threshold voltage change of the first transistor T1 is great, the discrepancy in the voltage levels of the first gate power source GVGH and the first emission power source EVGH may be accordingly determined to be great.

According to the operation of the EM signal control circuit as described above, the EM signal EM may stably keep to the voltage level of −6V in the time section "t3" and the time section "t4". Further, the EM signal control circuit may perform the same operation in a time section "t5" and a time section "t6" as in the time section "t3" and the time section "t4", and thus the EM signal EM may also stably keep to the voltage level of −6V in the time section "t5" and the time section "t6".

Figure 8:
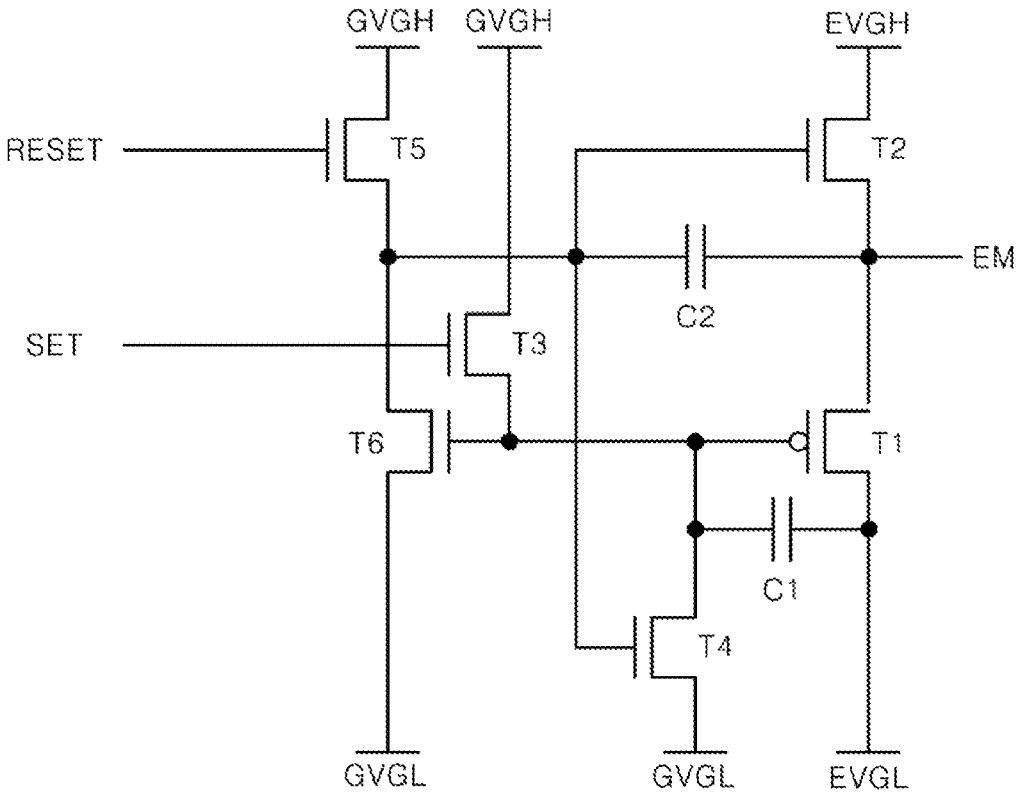
FIG. 8 is a configuration diagram illustrating an EM signal control circuit in accordance with another embodiment of the present invention.

FIG. 8 is a configuration diagram illustrating an EM signal control circuit in accordance with another embodiment of the present invention.

The configuration and operation of the EM signal control circuit of FIG. 8 may be the same as the configuration and operation of the EM signal control circuit described with reference to FIGS. 6 and 7 except that the first to sixth transistors T1 to T6 included in the EM signal control circuit of FIG. 6 are implemented by the PMOS transistors while first to sixth transistors T1 to T6 included in the EM signal control circuit of FIG. 8 are implemented by the NMOS transistors.

In some embodiments, voltage levels of a first emission power source EVGL, a second emission power source EVGH, a first gate power source GVGL, and a second gate power source GVGH may be set to respectively have opposite levels to the first emission power source EVGH, the second emission power source EVGL, the first gate power source GVGH, and the second gate power source GVGL described with reference to FIGS. 6 and 7. For example, in the EM signal control circuit of FIG. 8, the voltage levels of the first emission power source EVGL, the second emission power source EVGH, the first gate power source GVGL, and the second gate power source GVGH may be set to −6V, 14V, −8V, and 14V, respectively. The voltage levels (i.e., −8V and −6V) of the first gate power source GVGL and the first emission power source EVGL in the EM signal control circuit of FIG. 8 may also be differently set from each other in order to prevent the erroneous change of the voltage level of the EM signal EM in the time section "t4" or the time section "t6" as described with reference to FIG. 7.

In accordance with an embodiment of the present invention, the EM signal control circuit may prevent the floating of the output node even when the transistors coupled to the output node are turned off during the EM duty drive of the EM signal control circuit.

Further, in accordance with an embodiment of the present invention, the EM signal control circuit may prevent the voltage level change of the EM signal during the EM duty drive of the EM signal control circuit despite the threshold voltage change of the transistor coupled to the output node.

While the present invention has been described with respect to the specific embodiments, it will be apparent to those skilled in the art that various changes and modifications may be made without departing from the spirit and scope of the invention as defined in the following claims.

What is claimed is:

1. An emission (EM) signal control circuit of an organic light emitting display device, the EM signal control circuit comprising:

a first transistor, wherein a drain electrode of the first transistor is coupled to a first emission power source, a gate electrode of the first transistor is coupled to a QB node, and the first transistor is configured to output a voltage of the first emission power source to an output node coupled to a source electrode thereof in response to a set signal;

a second transistor, wherein a source electrode of the second transistor is coupled to a second emission power source, a gate electrode of the second transistor is coupled to a Q node, and the second transistor is configured to output a voltage of the second emission power source to the output node coupled to a drain electrode thereof in response to a reset signal;

a third transistor, wherein a source electrode of the third transistor is coupled to a second gate power source, a drain electrode of the third transistor is coupled to the QB node, and the third transistor is configured to transfer a voltage of the second gate power source to the QB node in response to the set signal;

a fourth transistor, wherein a drain electrode of the fourth transistor is coupled to a first gate power source, a source electrode of the fourth transistor coupled to the QB node, a gate electrode of the fourth transistor is coupled to the Q node, and the fourth transistor is configured to transfer a voltage of the first gate power source to the QB node in response to the reset signal;

a first capacitor coupled between the QB node and the drain electrode of the first transistor;

a fifth transistor, wherein a source electrode of the fifth transistor is coupled to the second gate power source, a drain electrode of the fifth transistor is coupled to the Q node, and the fifth transistor is configured to transfer the voltage of the second gate power source to the Q node in response to the reset signal; and a sixth transistor, wherein a source electrode of the sixth transistor is coupled between the drain electrode of the fifth transistor and the Q node, a drain electrode of the sixth transistor is coupled to the first gate power source, and a gate electrode of the sixth transistor is coupled between the QB node and the drain electrode of the third transistor.

2. The EM signal control circuit of claim 1, wherein the EM signal control circuit is configured to:

in response to the gate electrode of the third transistor receiving the set signal, the third transistor is turned on, and in response to the third transistor being turned on by the set signal, the first transistor is turned on after the third transistor is on, and the voltage of the first emission power source is outputted to the output node; and the first capacitor maintains the voltage of the second gate power source.

3. The EM signal control circuit of claim 2, wherein when the third transistor is turned off by the set signal, the first transistor remains is turned on due to the voltage of the second gate power source maintained by the first capacitor.

4. The EM signal control circuit of claim 1, wherein when the second transistor is turned on by the reset signal, the voltage of the second emission power source is outputted to the output node, the fourth transistor is turned on, and the first transistor turns off due to the voltage of the gate electrode of the first transistor.

5. The EM signal control circuit of claim 1, wherein a level of the voltages of the first emission power source and a level of the voltages of the first gate power source are different from each other.

6. An emission (EM) signal control method of an organic light emitting display device, the EM signal control method comprising:

turning on a third transistor and first and sixth transistors both coupled to the third transistor at a QB node by applying a set signal to output a voltage of a first emission power source to an output node;

turning off the third transistor and outputting the voltage of the first emission power source to the output node using a voltage maintained by a first capacitor, wherein the first capacitor is coupled between a drain electrode of the first transistor and the QB node; and turning on a fifth transistor and a second transistor coupled to the fifth transistor at a Q node by applying a reset signal to output a voltage of a second emission power source to the output node, wherein a source electrode of the sixth transistor is coupled between a drain electrode of the fifth transistor and the Q node, a drain electrode of the sixth transistor is coupled to a first gate power source, and a gate electrode of the sixth transistor is coupled between the QB node and a drain electrode of the third transistor.

7. The EM signal control method of claim 6, wherein when the third transistor is turned on, the first capacitor maintains a voltage of a second gate power source.

8. The EM signal control method of claim 6, wherein when the fifth transistor is turned on, a fourth transistor coupled to the fifth transistor at the Q node is turned on and the first transistor turns off due to a voltage of the first gate power source provided through the fourth transistor.

9. The EM signal control method of claim 8, wherein a level of the voltage of the first emission power source and a level of the voltage of the first gate power source are different from each other.

10. An organic light emitting display device comprising:

a panel including a plurality of pixels;

a plurality of shift registers configured to provide scan signals to the respective pixels; and an emission (EM) signal control circuit coupled to the plurality of shift registers and configured to provide EM signals to the respective pixels, wherein the EM signal control circuit includes:

a first transistor, wherein a drain electrode of the first transistor is coupled to a first emission power source, a gate electrode of the first transistor is coupled to a QB node, and the first transistor is configured to output a voltage of the first emission power source to an output node coupled to a source electrode thereof in response to a set signal;

a second transistor, wherein a source electrode of the second transistor is coupled to a second emission power source, a gate electrode of the second transistor is coupled to a Q node, and the second transistor is configured to output a voltage of the second emission power source to the output node coupled to a drain electrode thereof in response to a reset signal;

a third transistor, wherein a source electrode of the third transistor is coupled to a second gate power source, a drain electrode of the third transistor is coupled to the QB node, and the third transistor is configured to transfer a voltage of the second gate power source to the QB node in response to the set signal;

a fourth transistor, wherein a drain electrode of the fourth transistor is coupled to a first gate power source, a source electrode of the fourth transistor coupled to the QB node, a gate electrode of the fourth transistor is coupled to the Q node, and the fourth transistor is configured to transfer a voltage of the first gate power source to the QB node in response to the reset signal;

a first capacitor coupled between the QB node and the drain electrode of the first transistor;

a fifth transistor, wherein a source electrode of the fifth transistor is coupled to the second gate power source, a drain electrode of the fifth transistor is coupled to the Q node, and the fifth transistor is configured to transfer the voltage of the second gate power source to the Q node in response to the reset signal; and a sixth transistor, wherein a source electrode of the sixth transistor is coupled between the drain electrode of the fifth transistor and the Q node, a drain electrode of the sixth transistor is coupled to the first gate power source, and a gate electrode of the sixth transistor is coupled between the QB node and the drain electrode of the third transistor.

11. The organic light emitting display device of claim 10, wherein the EM signal control circuit is configured to:

in response to the gate electrode of the third transistor receiving the set signal, the third transistor is turned on, and in response to the third transistor being turned on by the set signal, the first transistor is turned on after the third transistor is on, and the voltage of the first emission power source is outputted to the output node and the first capacitor maintains the voltage of the second gate power source.

12. The organic light emitting display device of claim 11, wherein when the third transistor is turned off by the set signal, the first transistor remains turned on due to the voltage of the second gate power source maintained by the first capacitor.

13. The organic light emitting display device of claim 10, wherein when the second transistor is turned on by the reset signal, the voltage of the second emission power source is outputted to the output node, the fourth transistor is turned on, and the first transistor turns off due to the voltage of the first gate electrode.

14. The organic light emitting display device of claim 10, wherein a level of the voltages of the first emission power source and a level of the voltages of the first gate power source are different from each other.

* * * * *